US007225896B2

(12) United States Patent
Broad

(10) Patent No.: US 7,225,896 B2
(45) Date of Patent: Jun. 5, 2007

(54) COLLAPSIBLE HANDRAIL MECHANISM

(76) Inventor: Kerry Charles Broad, 55 Malonga Drive, Burnie, Tasmania (AU) 7320

( * ) Notice: Subject to any disclaimer, the term of this patent is extended or adjusted under 35 U.S.C. 154(b) by 0 days.

(21) Appl. No.: 10/656,644

(22) Filed: Sep. 5, 2003

(65) Prior Publication Data

US 2004/0046163 A1 Mar. 11, 2004

(30) Foreign Application Priority Data

Sep. 6, 2002 (AU) ..... 2002951228
May 30, 2003 (AU) ..... 2003204435

(51) Int. Cl.
*E06C 7/18* (2006.01)
*E06C 9/00* (2006.01)

(52) U.S. Cl. ..... 182/106; 256/59; 256/65.01; 182/163; 150/443; 150/447

(58) Field of Classification Search ..... 256/1.59; 182/106, 163; 248/370, 395, 397, 421, 591, 248/595; 403/65, 66, 68, 113, 117, 99, 159; 244/129.6; 105/443, 447
See application file for complete search history.

(56) References Cited

U.S. PATENT DOCUMENTS 1,018,232 A * 2/1912 Bessler ..... 182/79
1,444,156 A * 2/1923 Kemp ..... 105/447
1,724,824 A * 8/1929 Charles ..... 182/79
1,869,060 A * 7/1932 Harter ..... 403/113
2,209,576 A * 7/1940 McDonald ..... 182/88
2,467,800 A * 4/1949 Backlin et al. ..... 414/141.4
2,845,317 A * 7/1958 Orman ..... 403/113
2,990,148 A * 9/1961 Varnell ..... 182/127
3,083,784 A * 4/1963 Urian ..... 182/88
3,865,340 A * 2/1975 Ellis ..... 248/421
4,118,816 A * 10/1978 Mittag ..... 182/106
6,003,633 A * 12/1999 Rolson ..... 182/106
6,334,593 B2 * 1/2002 Inoue ..... 248/95
6,379,102 B1 * 4/2002 Kameda ..... 414/546

FOREIGN PATENT DOCUMENTS

GB 2270948 A * 3/1994

* cited by examiner

*Primary Examiner*—Daniel P. Stodola
*Assistant Examiner*—Ernesto Garcia
(74) *Attorney, Agent, or Firm*—Volpe & Koenig

(57) ABSTRACT

A collapsible handrail mechanism for steps or a ladder including:

Figure 1:
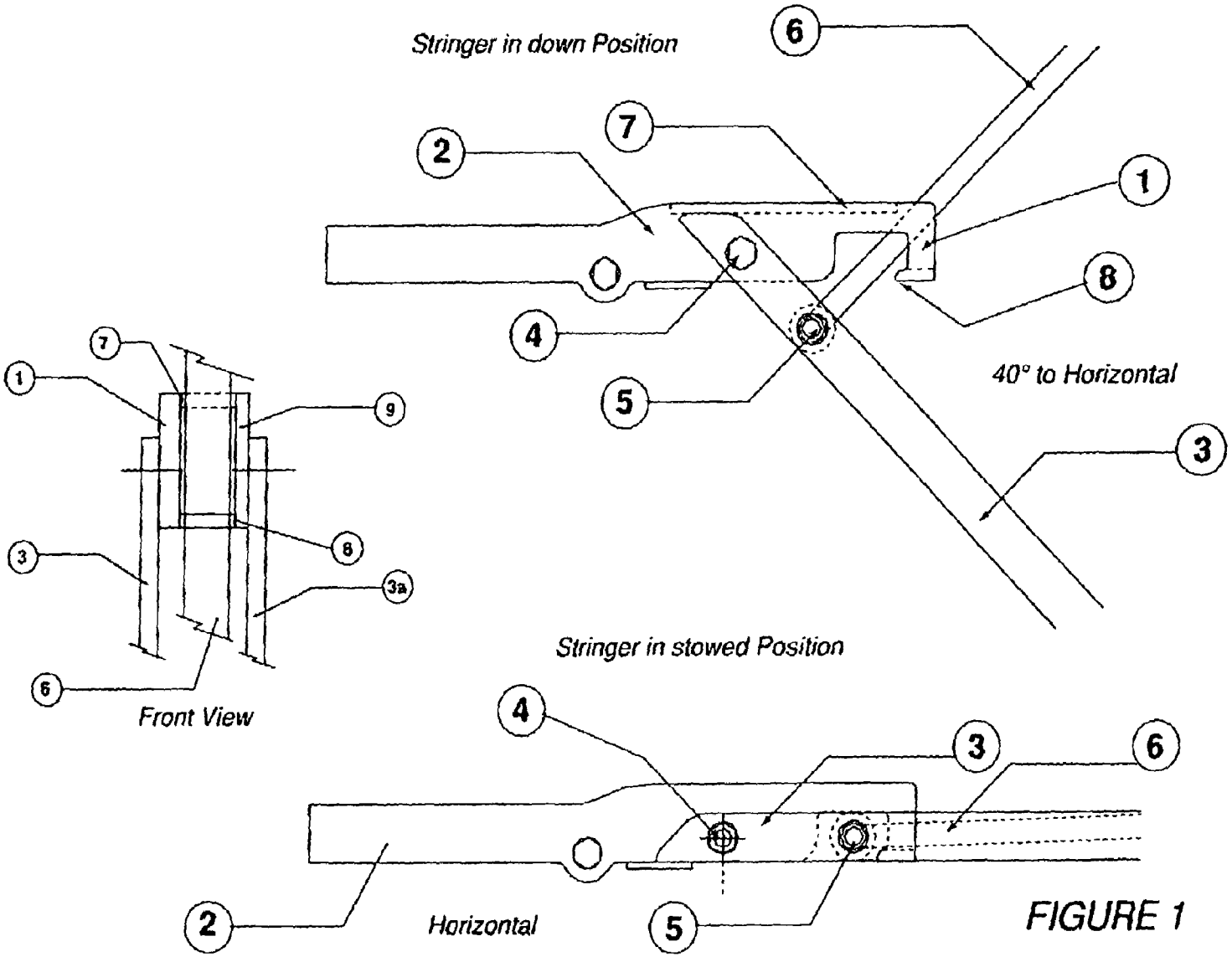

an outer stringer and an inner stringer jointly pivotable about a pivot point;

a stanchion located between the outer and inner stringers and pivotally mounted to at least one of the stringers;

a latching mechanism through which the stanchion passes and to which at least one of the stringers is pivotally mounted at the said pivot point;

the latching mechanism having a slide plate preventing substantial downwards movement of the stanchion, a top plate preventing substantial upwards movement of the stanchion, and a side plate preventing substantial sideways movement of the stanchion;

whereas, in operation of the handrail mechanism from a stowed position, when the stringers are lowered the stanchion is thereby forced to slide on the slide plate causing the stanchion to pivot about its mounting up into an operational position.

9 Claims, 3 Drawing Sheets

COLLAPSIBLE HANDRAIL MECHANISM

FIELD OF INVENTION

The invention relates to an improvement for stairs and ladders by providing a sturdy collapsible handrail.

BACKGROUND

Ladders and stairways have always been a problem to negotiate, especially when not permanently secured. This invention has sought to overcome this problem by attaching a collapsible handrail mechanism to either or both sides of the stairway or ladder. The invention is particularly intended to be suitable for use with collapsible stairways or ladders.

The purpose of the handrail invention is to give sturdy support in all directions and height variations. It is suitable, for example, for marine gangways in which tides vary stair heights and is intended to be safe and sturdy at any height of tide.

The transport industry could also gain from the invention, as getting on and off machinery has been a safety concern.

Industry has similar problems where stairways need to be folded away to allow access, such as for cranes and machinery.

SUMMARY

A collapsible handrail mechanism for steps or a ladder includes an outer stringer and an inner stringer jointly pivotable about a pivot point, a stanchion located between the outer and inner stringers and pivotally mounted to at least one of the stringers, a latching mechanism through which the stanchion passes and to which at least one of the stringers is pivotally mounted at the said pivot point. The latching mechanism has a slide plate that prevents substantial downwards movement of the stanchion, a top plate that prevents substantial upwards movement of the stanchion, and a side plate that prevents substantial sideways movement of the stanchion. In operation of the handrail mechanism from a stowed position, when the stringers are lowered the stanchion is thereby forced to slide on the slide plate causes the stanchion to pivot about its mounting up into an operational position.

BRIEF DESCRIPTION OF THE DRAWING(S)

Figure 2C:
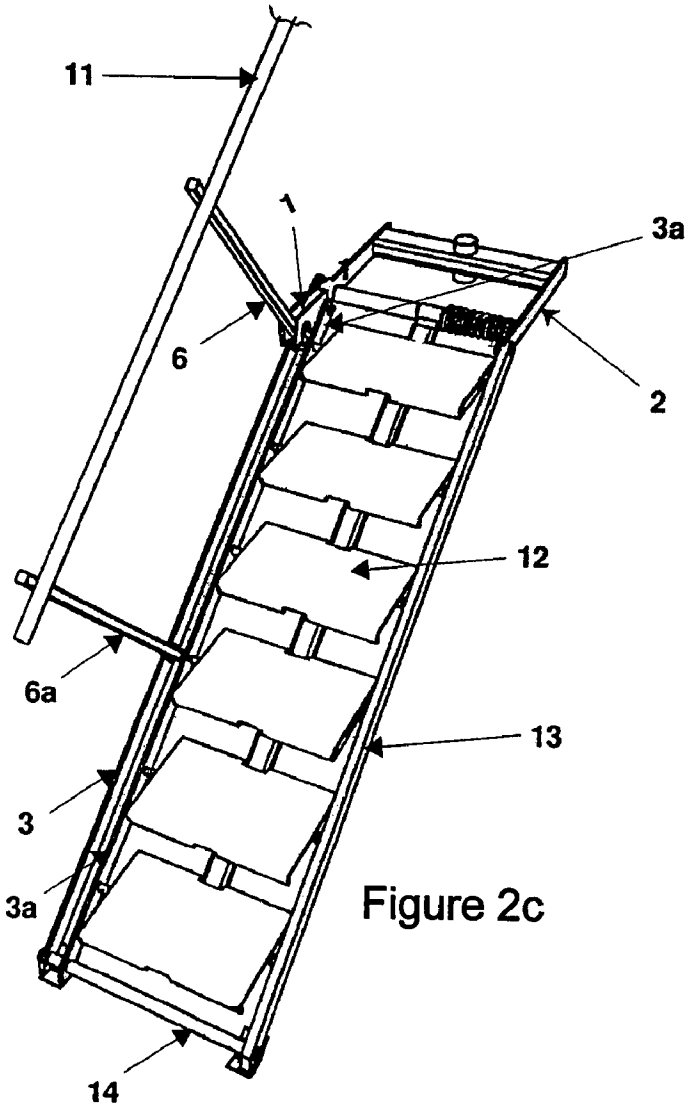
Figure 2A:
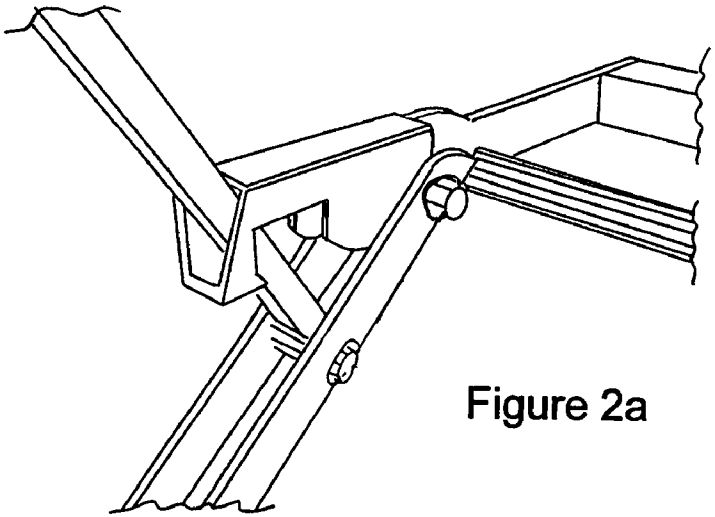
Figure 2B:
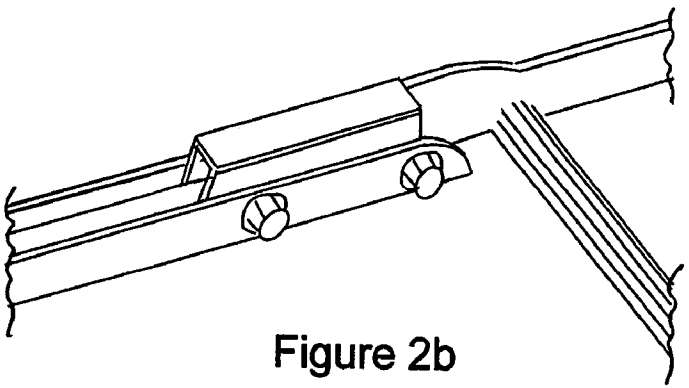
Figure 3B:
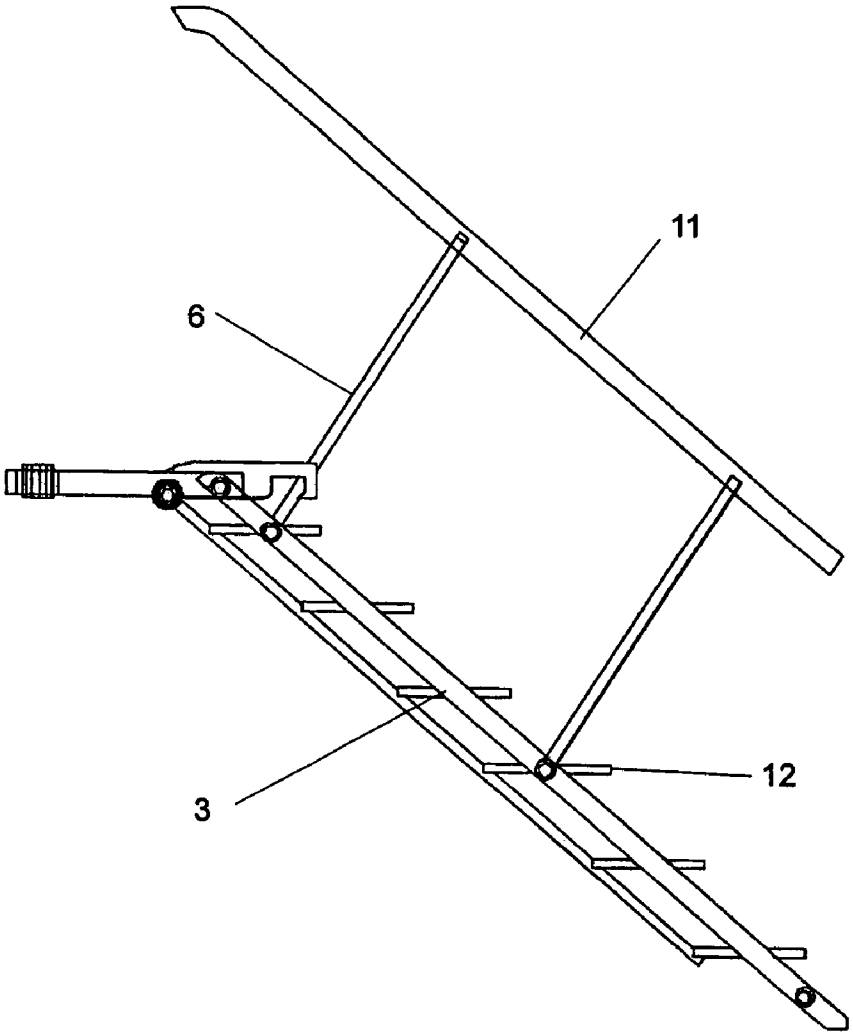
Figure 3A:
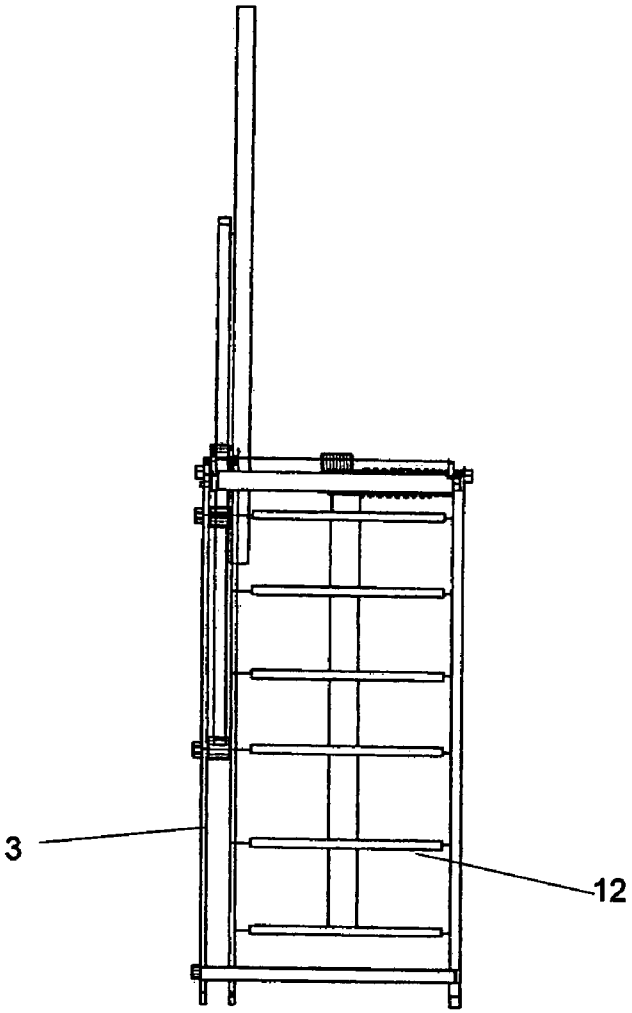

To assist with understanding the invention, reference will now be made to the accompanying drawings, which show one example of the invention, in which:

FIG. 1 shows the mechanical operation of the invention illustrating the stringer in the stowed and down positions, and FIGS. 1*a* and 1*b* show front and side views respective, FIG. 1*b* showing the stringer in the down position;

FIG. 2*c* shows the invention attached to a set of collapsible stairs;

FIGS. 2*a* and 2*b* show detailed views of the mechanism illustrated in FIG. 2*c*, shown in the extended ("down") and stowed positions, respectively; and FIGS. 3*a* and 3*b* show alternative views of the invention as illustrated in FIG. 2*c*.

Integers used in Figures: Handrail latching mechanism, (1); Stair carriage, (2) Outer stringer, (3); Inner stringer, (3*a*); Pivot pin, (4); Stanchion pin, (5); Stanchion, (6); Top plate, (7); Slide plate, (8); Inner plate, (9); Handrail, (11); Stair tread, (12); Right hand stringer, (13); Lift bar, (14).

DETAILED DESCRIPTION OF THE PREFERRED EMBODIMENT(S)

Referring to FIGS. 1, 1*a*, and 1*b*, it can be seen that the handrail mechanism (1) is attached to the stair carriage (2) with an outer stringer (3) and inner stringer (3*a*) located to the carriage by a pivot pin (4). The stanchion is located between the inner and outer stringer (3), (3*a*) by the stanchion pin (5).

The stanchion (6) slides through the latching mechanism (1) on the slide plate (8) preventing down movement. A top plate (7) prevents upwards movement and the inner plate (9) prevents any side movement.

In the operation of the handrail mechanism from the stowed position, when the stringer (3) and (3*a*) are lowered by the stairs or gangway the stanchion (6) is forced to slide on the slide plate (8) causing the stanchion (6), attached to the stingers by stanchion pin (5), to pivot up into the operational position.

FIG. 2*c* shows the handrail mechanism attached to a set of collapsible stairs to illustrate the mechanism in relation to the stairs. The parts being the latching mechanism (1), stringers (3) and (3*a*), stanchions (6) and (6*a*), handrail (11), step carriage assembly (2), treads (12), right hand stringer (13), lift bar for collapsible stairs (14).

FIG. 2*a* illustrates the mechanism in the down position and FIG. 2*b* shows the mechanism in the stowed position.

FIG. 3*a* is a two-dimensional front view of the handrail mechanism attached to collapsible stairs and FIG. 3*b* is a side view with the stairs shown in the down position.

The claims defining the invention are as follows:

1. A collapsible handrail mechanism comprising stairs:

a handrail for use with the stairs, the stairs connected to an inner stringer, the inner stringer and an outer stringer jointly pivotable about a pivot point;

a stanchion connected to the handrail and located between the outer and inner stringers and pivotally mounted to at least one of the stringers;

a latching mechanism through which the stanchion passes and to which at least one of the stringers is pivotally mounted at the pivot point;

the latching mechanism having a slide plate that prevents substantial downwards movement of the stanchion, a top plate that prevents substantial upwards movement of the stanchion, and a side plate preventing substantial sideways movement of the stanchion;

wherein, in operation of the handrail mechanism from a stowed position, when the stringers are lowered, the stanchion is thereby forced to slide on the slide plate causing the stanchion to pivot about the stanchion's mounting up into an operational position in which the handrail is raised upwardly and away from the stairs.

2. The collapsible handrail of claim 1, wherein the stanchion is pivotally mounted for rotation in a single plane.

3. A handrail mechanism that has at least a stowed position and a down position comprising:

at least one stair pivotally connected to an inner stringer spaced apart from, and oriented parallel to, an outer stringer;

a handrail oriented generally parallel to the outer stringer;

at least one stanchion joining the outer stringer to the handrail;

a latching mechanism through which the at least one stanchion passes, the latching mechanism having a slide plate that prevents substantial downwards movement of the stanchion, a top plate that prevents substantial upwards movement of the stanchion, and a side plate preventing substantial sideways movement of the stanchion;

wherein, in operation of the handrail mechanism from the stowed position to the down position, when the outer stringer is lowered, the stanchion is thereby forced to slide on the slide plate causing the stanchion to pivot about a stanchion mounting pin into the operational position in which the handrail is raised upwardly and away from the outer stringer.

4. A handrail mechanism that has at least a stowed position and a down position comprising:

at least one stair pivotally connected to an inner stringer spaced apart from, and oriented parallel to, an outer stringer;

a handrail oriented generally parallel to the outer stringer;

at least one stanchion joining the outer stringer to the handrail;

a latching mechanism through which the at least one stanchion passes, the latching mechanism having a slide plate that prevents substantial downwards movement of the stanchion, a top plate that prevents substantial upwards movement of the stanchion, and a side plate preventing substantial sideways movement of the stanchion;

wherein, in operation of the handrail mechanism from the stowed position to the down position, when the outer stringer is lowered, the stanchion is thereby forced to slide on the slide plate causing the stanchion to pivot about a stanchion mounting pin into the operational position in which the handrail is raised upwardly and away from the outer stringer;

wherein the stanchion is located between the outer and inner stringers and pivotally mounted to at least one of the stringers.

5. The handrail mechanism of claim 4, further comprising stairs pivotally mounted to the inner stringer.

6. The handrail mechanism of claim 4, wherein the latching mechanism is pivotally mounted at a pivot point to at least one of the stringers.

7. The handrail mechanism of claim 3, wherein in the stowed position, the stanchion is located generally parallel to the outer stringer.

8. The handrail mechanism of claim 6, wherein in the down position, the stanchion is located generally perpendicular to the outer stringer.

9. The collapsible handrail of claim 3, wherein the stanchion is pivotally mounted for rotation in a single plane.

* * * * *